United States Patent [19]

Ni et al.

[11] Patent Number: 5,058,395

[45] Date of Patent: Oct. 22, 1991

[54] SLUG SURGE SUPPRESSOR FOR REFRIGERATION AND AIR CONDITIONING SYSTEMS

[75] Inventors: Shimao Ni, Elmhurst; Phillip C. Heitz, South Elgin, both of Ill.

[73] Assignee: H. A. Phillips & Co., St. Charles, Ill.

[21] Appl. No.: 487,682

[22] Filed: Mar. 2, 1990

[51] Int. Cl.[5] ..... F25B 43/00

[52] U.S. Cl. ..... 62/278; 62/83; 62/217; 62/503; 62/511

[58] Field of Search ..... 62/83, 129, 217, 196.4, 62/278, 277, 503, 511, 81

[56] References Cited

U.S. PATENT DOCUMENTS 2,344,215 3/1944 Soling et al. ..... 62/278 X
3,626,715 12/1971 Bottum ..... 62/217 X
4,625,524 12/1986 Kimura et al. ..... 62/278

FOREIGN PATENT DOCUMENTS 178240 11/1906 Fed. Rep. of Germany ..... 62/511

*Primary Examiner*—Harry B. Tanner
*Attorney, Agent, or Firm*—Willian Brinks Olds Hofer Gilson & Lione

[57] ABSTRACT

A refrigeration and defrost system utilizing various valves for opening a defrost line to hot gas and regulating the pressure in refrigerant lines. A slug surge suppressor is provided at several points in the defrost and refrigerant lines to eliminate hydraulic shock damage caused by slugs of a liquid-gas mixture passing rapidly through the lines. The slugs are generally formed by the required rapid opening of a hot gas defrost valve and a pressure regulatory valve of the system. A series of capillary passages in the suppressor are operative to resist the flow of liquid while allowing gas to flow freely. Tangential velocity is imparted to the slug to separate the liquid and gas components of the slug.

4 Claims, 4 Drawing Sheets

SLUG SURGE SUPPRESSOR FOR REFRIGERATION AND AIR CONDITIONING SYSTEMS

RELATED APPLICATIONS

This invention is generally related to a commonly assigned copending U.S. patent application having Ser. No. 07/417,927, filed Oct. 6, 1989, entitled SHOCKLESS SYSTEM AND GAS VALVE FOR REFRIGERATION AND AIR CONDITIONING, and also to a continuation-in-part from that application having the same title. The entire disclosure of each of the above patent applications is incorporated herein by reference.

FIELD OF INVENTION

This invention relates generally to the field of refrigeration and air conditioning. More particularly, this invention relates to preventing hydraulic shock in refrigeration gas lines for industrial and commercial refrigeration and air conditioning systems.

BACKGROUND OF THE INVENTION

A conventional system for industrial and commercial refrigeration or air conditioning might employ ammonia, for example, as a refrigerant. The ammonia, in gaseous form, is compressed in a compressor, from which it is discharged at a higher temperature and pressure. The compressed refrigerant gas travels to a condenser where it is liquified at a lower temperature. Cooled liquid refrigerant then travels through evaporator coils where it performs its cooling or refrigeration function by removing heat from the surrounding environment through the coils.

The evaporator coils normally accumulate moisture and, accordingly, frost during operation. Periodically these evaporator coils have to be defrosted in order to maintain the efficiency of the system. There are four widely used methods of defrosting evaporator coils. These might be characterized as the air method, the water method, the electric method, and the hot gas method.

The hot gas defrost method is the most popular of the four. In the hot gas defrost method the supply of liquid refrigerant to the evaporator coil is interrupted and high pressure refrigerant vapor is delivered to the evaporator. While the high pressure refrigerant vapor is being delivered to the evaporator coil, the outlet of the coil is restricted so that a pressure is maintained in the coil. This provides a saturation temperature high enough to transfer heat to the frost or ice on the evaporator coils. As a result of this manipulation, the evaporator coil temporarily becomes a condenser coil. The latent heat given off into the frost during the condensation process is the major energy source for the defrost.

To begin the defrost cycle, a first solenoid valve downstream of the condenser is closed and a second solenoid valve in a bypass line which leads directly from upstream of the condenser to upstream of the evaporator is opened. These solenoid valves normally open and close rapidly. When the bypass line has some liquid in it in addition to the hot gas from the compressor (as is frequently the case) a "slug" of liquid or a liquid-gas mixture rapidly passes through the second solenoid valve and strikes downstream system components, including the evaporator. What is known as "hydraulic shock" occurs and, particularly where the system is operating at low temperatures, severe damage to the system can result.

A primary object of the invention is to provide an improved shockless, hot gas defrost refrigeration system for industrial and commercial refrigeration and air conditioning and the like.

It is another object to provide an improved refrigeration system wherein hydraulic shock damage to system components due to rapid opening of control valves is prevented.

Yet another object is to provide a refrigeration system wherein slug flow in the pipe line is prevented from rapidly moving downstream so as to cause hydraulic shock, a result potentially damaging to system components.

The foregoing and other objects are realized in accordance with the present invention by providing a slug surge suppressor device interposed in the gas line of a refrigeration system. The slug surge suppressor is advantageously placed downstream of the solenoid valve in the hot gas line, and also downstream of a pressure regulator valve which is downstream of the evaporator in a suction line.

In one aspect of the invention, the slug surge suppressor comprises a plurality of beads, fibers or other materials which act together to form numerous capillary passages. The beads are generally confined by first and second perforated screens. The numerous capillary passages resist liquid flow and lower liquid pressure, but allow gas to flow freely without a significant drop in gas pressure. The pressure drop in the liquid not only moderates (i.e., slows down) the slug surge, but also makes the liquid evaporate rapidly. Thus, slug surge is prevented.

In another aspect of the invention, the slug surge suppressor as described above further includes an alarm system and a third perforated screen located downstream of the second (downstream-most) perforated screen, and electrically insulted from the same. The alarm system is connected in such a way to detect breakage of the second screen and sound the alarm. The third screen confines the beads upon breakage of the second screen to prevent the beads from traveling downstream and causing damage to system components.

In another aspect of the invention, the slug surge suppressor includes a set of turbine-like blades which impart a tangential velocity to the liquid-gas slug. The tangential velocity and different densities of the liquid and gas causes each to flow along a different path. The gas will flow directly downstream to the outlet port through one passage which is directed toward the middle of the slug surge suppressor. The liquid will tend to swirl downstream along an innerwall of the slug surge suppressor body. The liquid then passes through a plurality of beads which act together to form numerous capillary passages which resist liquid flow by viscous effects and lower liquid pressure. The pressure drop in the liquid not only moderates the slug surge, but also makes the liquid evaporate rapidly. Thus, slug surge is prevented.

In yet another aspect of the invention, the slug surge suppressor utilizes a circular non-perforated plate to impart a tangential velocity to the liquid-gas slug. The tangential velocity and different densities of the liquid and gas causes each to flow through the slug surge suppressor along a different path in a manner similar to that described immediately above.

BRIEF DESCRIPTION OF THE DRAWINGS

The invention, including its construction and method of operation, together with additional objects and advantages thereof, is illustrated more or less diagrammatically in the drawings, in which.

DESCRIPTION OF THE PREFERRED EMBODIMENTS

Figure 1:
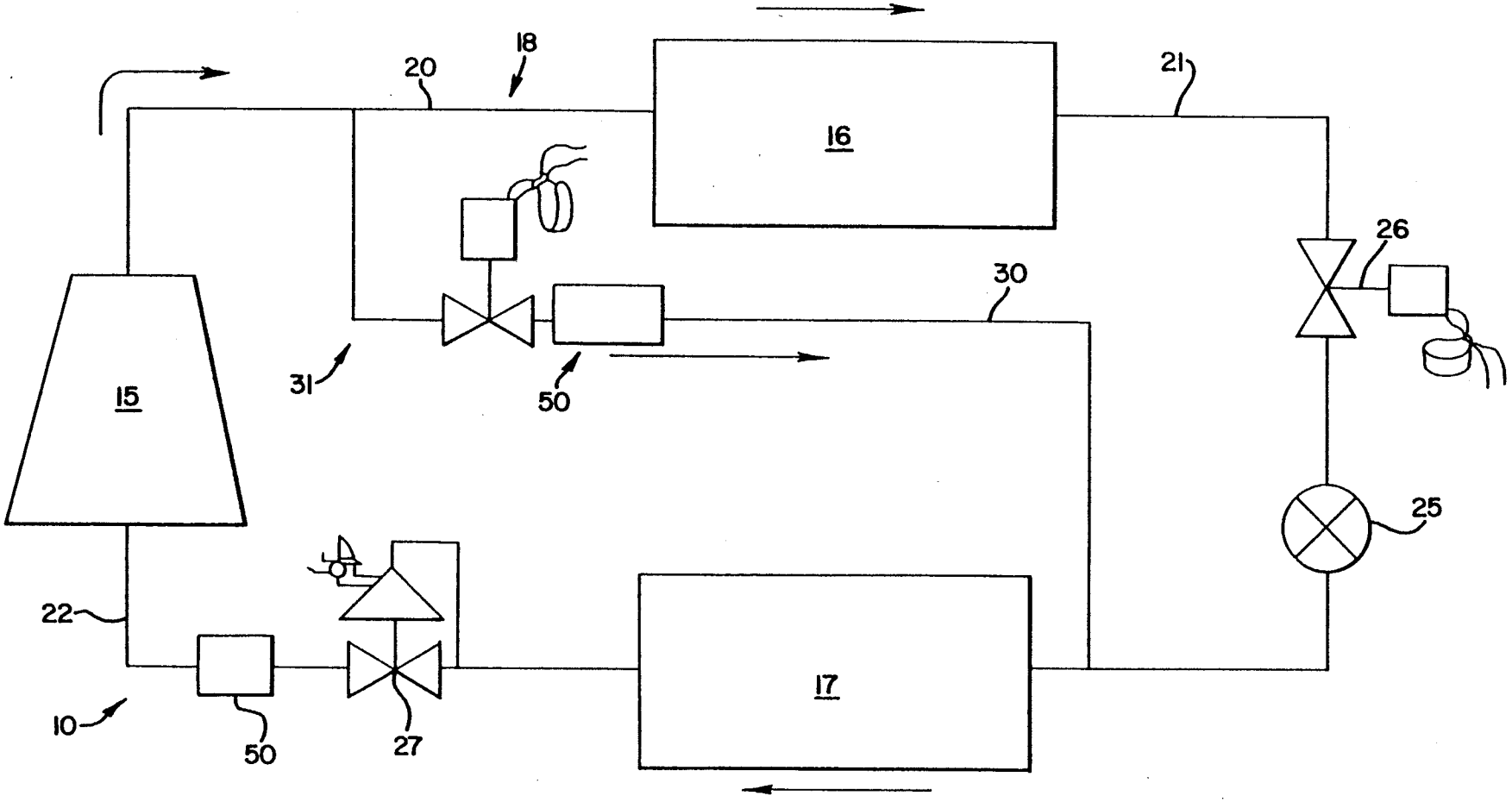
FIG. 1 is a block diagram of a system embodying features of the present invention.

Referring now to the drawings, and particularly to FIG. 1, a system embodying the features of the present invention is illustrated in block diagram at 10. The system 10 is illustrated in the context of a commercial refrigeration system and includes a refrigerant compressor 15 in closed circuit with a condenser 16 and an evaporator 17, all connected by a pipe assembly 18. The compressor 15 and the condenser 16 are connected by a pipe segment 20, the condenser and evaporator by a pipe segment 21, and the evaporator and compressor by a pipe segment 22. These components are of known construction and arrangement and are commercially available.

The pipe segment 21 includes an expansion valve 25. Upstream, next to the expansion valve 25, a solenoid operated control valve 26 is mounted in the pipe segment 21. The control valve 26 is designed to selectively close communication between the condenser 16 and the evaporator 17 through the pipe segment 21 during hot gas defrost.

The pipe segment 22 includes a pressure regulator valve 27. The pressure regulator valve 27, downstream of the evaporator 17 and upstream of the compressor 15, regulates the flow of gaseous refrigerant to the compressor from the evaporator.

The system 10 also includes a hot gas defrost pipe segment 30. The pipe segment 30 is connected to the pipe segment 20 upstream of the condenser 16, and to the pipe segment 21 downstream of the expansion valve 25 and upstream of the evaporator 17. A solenoid operated defrost valve 31 is disposed in the hot gas defrost pipe segment 30. A first slug surge suppressor device 50 embodying the features of the present invention is located directly downstream of the solenoid valve 31, and a second suppressor device 50, essentially identical to the first, is located directly downstream of the pressure regulator valve 27.

In the normal operation of the system 10 as a refrigeration system, the compressor 15 receives refrigerant gas from the evaporator 17 through the pressure regulator valve 27. The evaporator 17, in performing its refrigeration function in a commercial refrigeration system, for example, has converted the refrigerant from a liquid to a gas. This gas is compressed by the compressor 15, after which it passes downstream through the pipe 20 into the condenser 16.

The condenser 16 liquifies the pressurized gas by removing heat from the gas, and the liquified refrigerant leaves the condenser 16 through the pipe segment 21 for the expansion valve 25. In the expansion valve 25 a reduction in pressure of the liquified refrigerant takes place. The liquified refrigerant, at a reduced pressure, passes downstream into the evaporator 17 where it evaporates, absorbing heat from its surroundings.

During a refrigeration operation of the aforedescribed nature, it is not unusual for the evaporator coils to accumulate frost as the system operates. This frost builds up especially rapidly where a system is operating in a high humidity environment. As the frost builds up, the refrigeration effect of the evaporator coils is reduced.

Normally the hot gas defrost pipe segment 30 is closed by the hot gas defrost valve 31 while the pipe segment 21 remains open through valve 26. When a defrost cycle is called for the valve 26 is closed and the hot gas defrost valve 31 is opened. The pressure regulator valve 27 is held wide open during normal refrigeration operation, but is de-energized during defrost and becomes a regulator of pressure of the evaporator 17.

With the valve 26 closing off the pipe segment 21, and the hot gas defrost valve 31 opening the pipe segment 30, high pressure refrigerant gas is delivered to the evaporator 17. While this high-pressure gas is being supplied to the evaporator 17, the outlet from the coil of the evaporator 17 is restricted by the pressure regulator valve 27 so that sufficient pressure is maintained in the evaporator coil to provide a saturation temperature high enough to melt the frost. During defrost the evaporator coil functions as a condenser.

When the pipe segment 30 has some liquid in it in addition to the hot gas from the compressor 15, a slug comprising either liquid or a liquid-gas mixture, rapidly passes through the valve 31 and strikes downstream system components including the evaporator. When the hot gas defrost process finishes, the pressure regulator valve 27 is energized and the main passage of the valve 27 opens rapidly. Since the pressure that has built up in the evaporator 17 for defrosting is much higher than the suction pressure, this pressure differential can move the liquid-gas slug in the evaporator 17 rapidly downstream. As the slug surges into downstream components or the compressor, serious damage can be caused. In order to prevent the rapid passage of slugs through the system, the slug surge suppressor 50 of the present invention has been developed. The slug surge suppressors 50, as seen in FIG. 1, are positioned downstream of the hot gas defrost valve 31 in the pipe segment 30, and downstream of the pressure regulatory valve 27 in the pipe segment 22.

Figure 2:
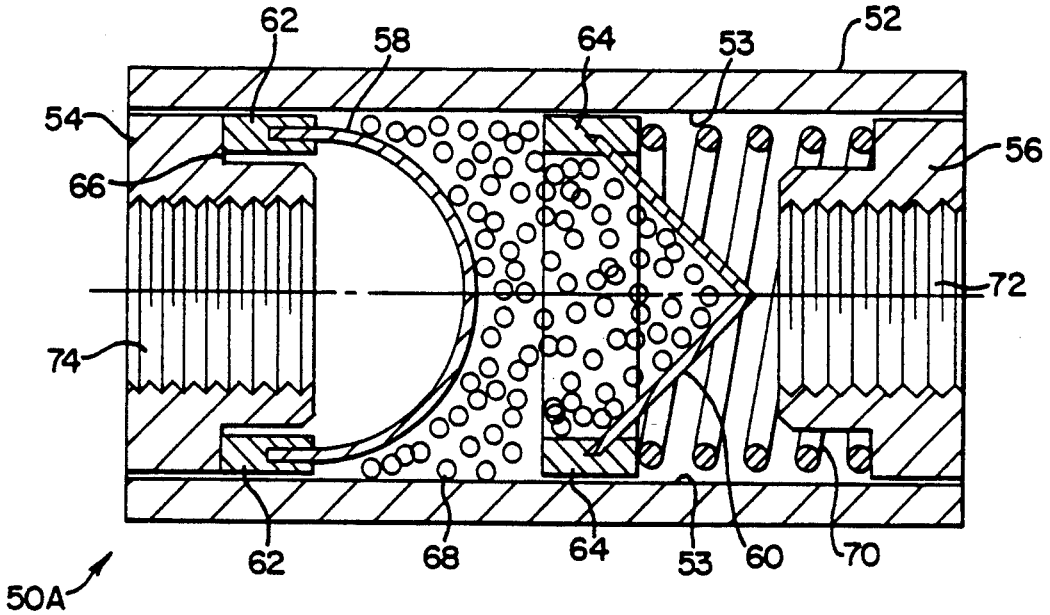
FIG. 2 is a partial sectional view of a first embodiment of a slug surge suppressor for the system illustrated in FIG. 1.

Referring now to FIG. 2, a first embodiment of the slug surge suppressor is illustrated in detail at 50A. The slug surge suppressor 50A generally comprises a cylindrical body 52 having pipe fitting elements 54 and 56 each located at opposite ends of the cylindrical body 52. The pipe fitting elements 54, 56 are preferably welded in place to an inside wall 53 of the cylindrical body 52. A dome-shaped perforated screen 58 is attached around its edge to a first ring-shaped holder 62. The ring-shaped holder 62 is sized to fit snugly inside a circular groove formed by a shoulder element 66 of the pipe fitting element 54 and the inner wall 53 of the cylindrical body 52.

A cone-shaped perforated screen 60 is attached around its edge to a second ring-shaped holder 64, sized to fit movably against the innerwall 53 of the cylindrical body 52. The cone-shaped screen 60 and second holder 64 are located immediately upstream of the dome-shaped screen 58 and first holder 62. In the area between the screens 58 and 60 are located a plurality of small beads 68 which are movable within the area and combine to form a series of capillary passages in the spaces therebetween.

A coil spring 70 is located in the area between the cone-shaped screen 60 and pipe fitting element 56. The spring 70 is biased at one end against the second ring-shaped holder 64 and at its other end against pipe fitting element 56, thereby securing the second holder 64 and cone-shaped screen 60 against the beads 68.

In operation, a slug (not shown), comprised of either liquid or a liquid-gas mixture, rapidly advances through the pipe segment 30 into the inlet port 72. The slug strikes against and passes through the cone-shaped screen 60. The non-planar shapes of the screens 58, 60 place less stress on them and make them stronger in order to resist breakage upon impact with the slug. The liquid-gas slug then passes through the series of beads 68. The beads 68 combine to form numerous capillary passages in the spaces therebetween, which act to resist the flow of liquid while at the same time presenting little resistance to gas flow with no significant pressure drop. The resistance of the beads 68 to liquid flow also lowers the liquid pressure, thereby flashing (i.e., vaporizing) most of liquid. The vaporized liquid then passes easily through the beads 68 in the same manner as described above for the gaseous component of the slug. The remaining unvaporized liquid is slowed down significantly as it passes through the beads 68 and the dome-shaped screen 58 to the outlet port 74. Thereby, slug surge is prevented.

Figure 3:
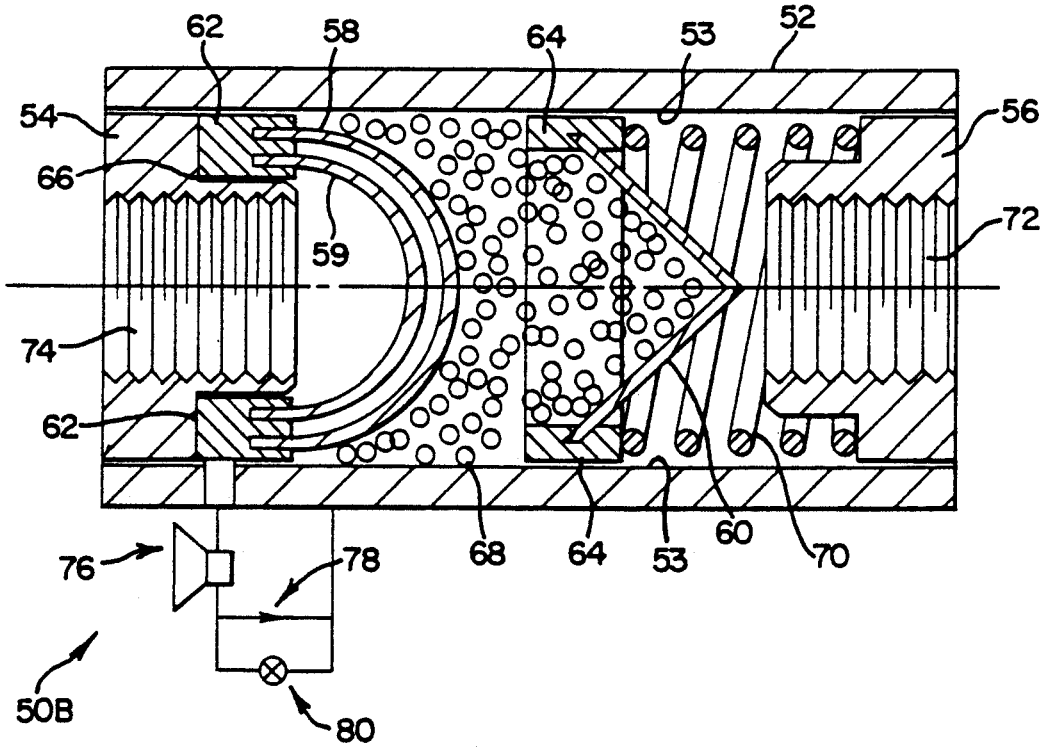
FIG. 3 is a partial sectional view of a second embodiment of a slug surge suppressor for the system of FIG. 1.

Referring now to FIG. 3 another embodiment of the slug surge suppressor is illustrated in detail at 50B. The slug surge suppressor at 50B is identical to that illustrated in FIG. 2, with the addition of a second dome-shaped screen 59 and an alarm system for detecting breakage of the first dome-shaped screen 58.

If, during operation of the slug surge suppressor illustrated in FIG. 2, the dome-shaped screen 58 breaks and the beads pass through the outlet port 74, the beads 68 could cause damage to downstream system components. To prevent this, the second dome-shaped screen 59 is provided as shown in FIG. 3, with the two screens 58 and 59 being electrically insulated one from the other. An alarm 76 is connected in series with the second dome-shaped screen 59 and one terminal of a battery 78. A second terminal of the battery 78 is connected in series with the cylindrical body 52, the beads 68 and the first dome-shaped screen 58, leaving a short between the screens 58 and 59. If the first dome-shaped screen 58 breaks, the beads 68 will fill in the spacing between the screens and complete the circuit between the battery 78 and the alarm 76. In this regard, the beads 68, screens 59 and 58, and the cylindrical body 52 should all be made from electrically conductive material. The alarm then sounds, notifying the user that the first screen has broken. Although the alarm 76 warns the user that one screen has broken, the unit is still completely functional since the second dome-shaped screen 59 is still operative to confine the beads 68 and prevent them from traveling downstream. Since the screens typically last many years before breakage, a battery indicator 80 is included to signal the user if the battery 78 dies out over time.

Figure 4A:
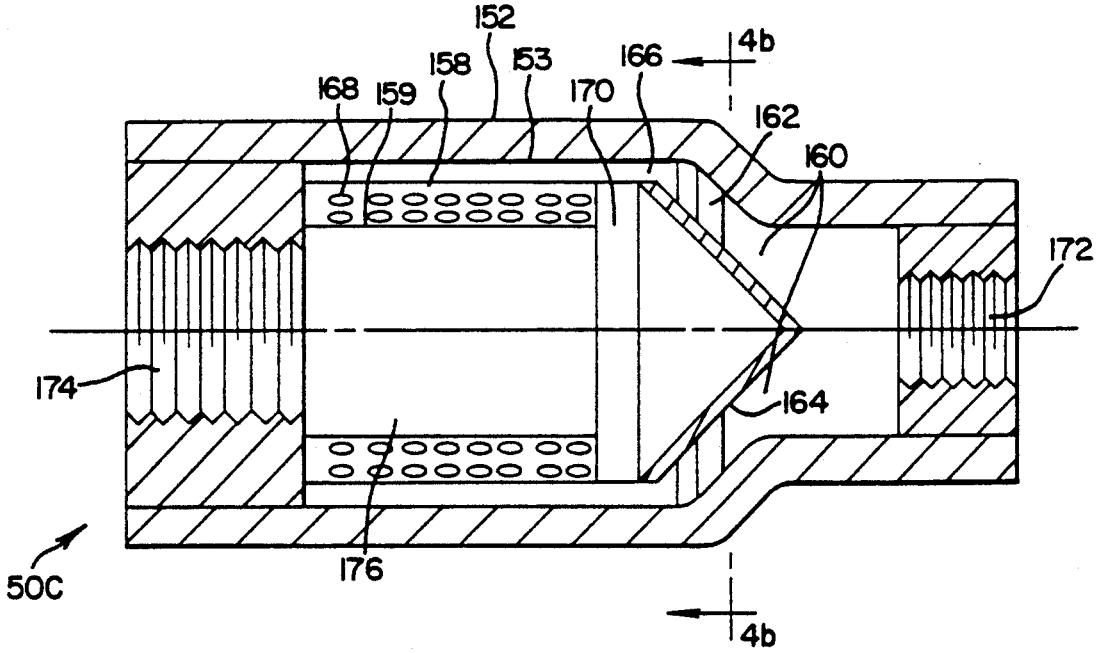
FIG. 4*a* is a partial sectional view of a third embodiment of a slug surge suppressor for the system of FIG. 1.
Figure 4B:
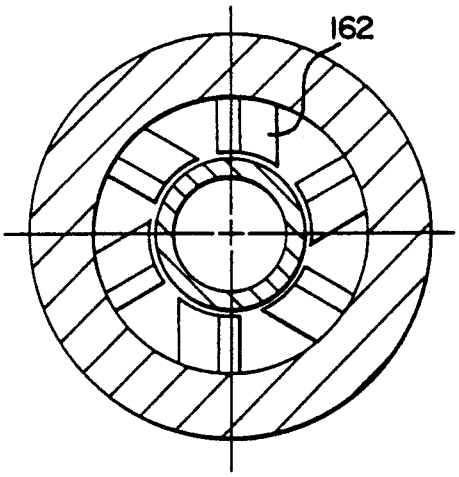
FIG. 4*b* is a sectional view of the slug surge suppressor of FIG. 4*a* taken along line A—A.

Referring now to FIG. 4, another embodiment of the slug surge suppressor is illustrated at 50C. The slug surge suppressor 50C comprises a generally cylindrical shaped body 152 having an inlet port 172 and an outlet port 174. Connecting the inlet port 172 to the outlet port 174 are a series of passages providing different pathways for the liquid and gas components of the slug. A cone-shaped divider 164 guides the slug through a set of turbine-like blades 162 which impart a tangential velocity to the slug. After the blades 162, the slug surge suppressor provides two pathways to the outlet port 174. One pathway is for the liquid component of the slug and includes a pair of circular perforated screens 158 and 159 having a plurality of beads 168 located in the space therebetween. The beads combine to form numerous capillary passages which act to resist the flow of liquid and lower the liquid pressure thereby flashing most of the liquid. A second pathway is for the gaseous component of the slug and comprises passages 166, 170, 176 and the outlet port 174. The second pathway allows the gas to flow unencumbered downstream.

In operation, the slug enters inlet port 172 and flows along passage 160. The slug is then guided by the blade 162 and obtains a tangential velocity. The gas and liquid components of the slug are then separated because of their different densities. The gas component flows downstream through the pathway formed by passages 166, 170, 176 and outlet port 174, while the liquid phase tends to swirl downstream along the inner wall 153 of the cylindrical body 152 due to large inertia forces caused by its greater mass and the tangential velocity. The liquid then passes through perforated screens 158, 159 and flow resisting material 168, such as beds of small beads, fibers and other materials which let liquid pass through with significant pressure drop. The liquid with reduced pressure and momentum flashes rapidly and flows downstream through passage 176 and the outlet port 174. Hence, the slug surge is suppressed.

Figure 5A:
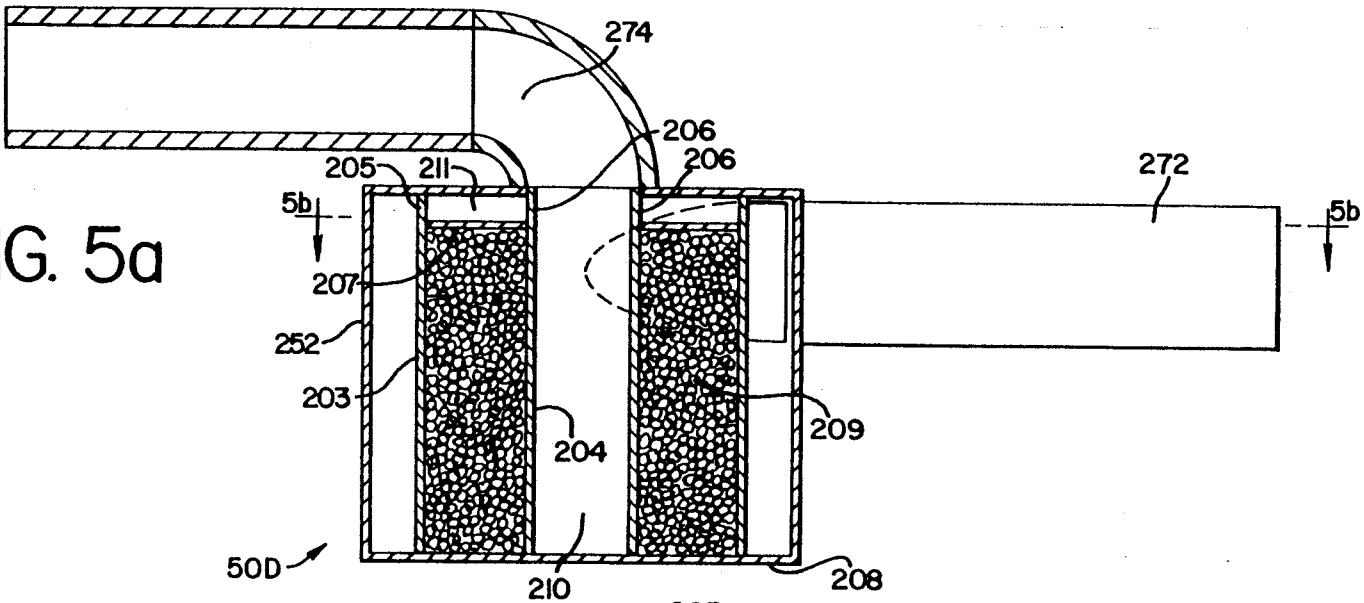
FIG. 5*a* is a partial sectional view of a fourth embodiment of a slug surge suppressor for the system of FIG. 1.
Figure 5B:
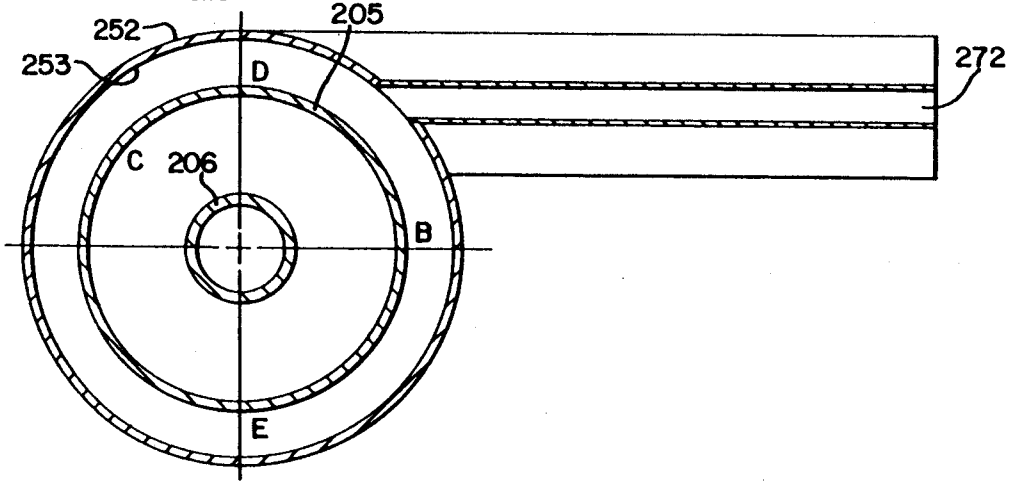
FIG. 5*b* is a sectional view of the slug surge suppressor of FIG. 5*a* taken along line A—A.

Referring now to FIGS. 5*a* and 5*b*, another embodiment of the slug surge suppressor is illustrated at 50D. Inside a suppressor body 252, there are two pair of lower concentric perforated cylindrical screens comprising an external screen 203, a core screen 204, and two upper screens 205 and 206. Located inside the volume formed by the combination of the two screens 203 and 204, a top plate 207 and a bottom plate 208, there are materials 209 (for example small beads or fibers) which form numerous capillary passages.

As a liquid and gas slug (not shown) enters the inlet port 272, the slug is given a tangential velocity by a solid portion of the upper screen 205, shown in FIG. 5*b* as section BDC. The slug is forced by the solid portion of the upper screen 205 to flow in a passage formed by portion BDC of the upper screen 205 and the suppressor wall 253. The BDC portion of the upper screen 205 is solid to prevent the slug from passing through and its CEB portion is perforated allowing liquid and gas to pass through. Due to its high density and high tangential velocity, the refrigerant liquid portion of the slug tends to flow and swirl near the wall 253, then flow through lower screen 203, the capillary passages in material 209 and the screen 204, with significant pressure drop. Refrigerant liquid with reduced pressure flashes rapidly at the core region 210, and moves downstream through an outlet port 274.

In contrast, due to its lower density and the relatively lower downstream pressure, the gas portion of the slug tends to flow through the perforated portion CEB of the upper screen 205, a passage 211, and perforated screen 206, and out through the outlet port 274.

While preferred embodiments of the invention have been described, it should be understood that the invention is not limited to them and modifications may be made without departing from the invention. For example, the slug surge suppressor of the present invention is not restricted to use in hot gas defrost systems, but may be used in any refrigeration system in which slug surge may be present. The scope of the invention is defined by the appended claims, and all devices that come within the meaning of the claims, either literally or by equivalents, are intended to be embraced therein.

I claim:

1. An improved refrigeration and defrost system wherein shock damage to system components due to rapid passage of a slug through the system is prevented, the slug generally comprising a mixture of liquid and gas, the system comprising:

a) a refrigerant compressor connected in closed circuit with a condensor and an evaporator by a pipe assembly;

b) said pipe assembly including a first pipe segment connecting the compressor and the condenser, a second pipe segment connecting the condenser and the evaporator, and a third pipe segment connecting the evaporator and the compressor;

c) a hot gas defrost pipe segment connected to said first pipe segment and the second pipe segment of said pipe assembly;

d) a hot gas defrost valve disposed in said hot gas defrost pipe segment, said hot gas defrost valve including means for opening said hot gas defrost pipe segment to a maximum extent to permit hot gas to flow therethrough during a hot gas defrost cycle; and e) a first slug surge suppressor disposed in said hot gas defrost pipe segment and downstream from said hot gas defrost valve, said slug surge suppressor including:

1) a body having an inlet port, an outlet port, outer walls and an interior center portion;

2) tangential velocity means located downstream of said inlet port for imparting tangential velocity to the slug entering said inlet port, such that the different densities of the gas and liquid components of the slug cause the liquid and gas components to separate, the liquid flowing downstream through a path oriented toward said outer wall and the gas flowing downstream through a path oriented toward said interior center portion;

3) a first passage located downstream of said tangential velocity means and leading to said outer port, said first passage oriented toward said outer wall in such a way that liquid passing through said tangential velocity means will tend to flow through said first passage;

4) said first passage further including a plurality of capillary passages; and 5) a second passage located downstream of said tangential velocity means and leading to said outlet port, said second passage oriented toward said interior center portion in such a way that gas passing through said tangential velocity means will end to flow through said second passage.

2. The system defined in claim 1 including:

a) a pressure regulatory valve disposed in said third pipe segment, said pressure regulatory valve including means for regulating evaporator pressure during said hot gas defrost cycle and opening said third pipe segment to a maximum extend during a refrigeration cycle to permit gas to flow therethrough; and b) a second slug surge suppressor disposed in said third pipe segment downstream from said regulatory valve.

3. An improved refrigeration and defrost system wherein shock damage to system components due to rapid passage of a slug through the system is prevented, the slug generally comprising a mixture of liquid and gas, the system comprising:

a) a refrigerant compressor connected in closed circuit with a condensor and an evaporator by a pipe assembly;

b) said pipe assembly including a first pipe segment connecting the compressor and the condenser, a second pipe segment connecting the condenser and the evaporator, and a third pipe segment connecting the evaporator and the compressor;

c) a hot gas defrost pipe segment connected to said first pipe segment and the second pipe segment of said pipe assembly;

d) a hot gas defrost valve disposed in said hot gas defrost pipe segment, said hot gas defrost valve including means for opening said hot gas defrost pipe segment to a maximum extent to permit hot gas to flow therethrough during a hot gas defrost cycle; and e) a first slug surge suppressor disposed in said hot gas defrost pipe segment and downstream from said hot gas defrost valve, said slug surge suppressor including:

1) a body having an inlet port, an outlet port and outer walls;

2) tangential velocity means located downstream of said inlet port for imparting tangential velocity to the slug entering said inlet port, such that the different densities of the gas and liquid components of the slug cause the liquid and gas components to separate, the liquid flowing through a first passage oriented toward said outer walls and the gas flowing through a second passage;

3) said first passage being located downstream of said tangential velocity means and leading to said outer port, said first passage oriented toward said outer wall in such a way that liquid passing through said tangential velocity means will tend to flow through said first passage; and 4) said first passage further including a plurality of capillary passages;

5) said second passage being located downstream of said tangential velocity means and leading to said outlet port, said second passage oriented toward said outlet port in such a way that said second passage provides a relatively more direct path to the lower downstream pressure than said first passage, whereby gas passing through said tangential velocity means will tend to flow through said second passage.

4. The system defined in claim 3 including:

a) a pressure regulatory valve disposed in said third pipe segment, said pressure regulatory valve including means for regulating evaporator pressure during said hot gas defrost cycle and opening said third pipe segment to a maximum extend during a refrigeration cycle to permit gas to flow therethrough; and b) a second slug surge suppressor disposed in said third pipe segment downstream from said regulatory valve.

* * * * *

UNITED STATES PATENT AND TRADEMARK OFFICE

CERTIFICATE OF CORRECTION

PATENT NO. : 5,058,395

DATED : October 22, 1991

INVENTOR(S) : Shimao Ni et al.

It is certified that error appears in the above-identified patent and that said Letters Patent is hereby corrected as shown below:

Column 2, line 39, delete "insulted" and substitute therefor --insulated--.

Column 4, line 24, after "for" insert --,--.

Column 5, line 6, delete "innerwall" and substitute therefor --inner wall--.

Column 5, line 34, after "of" insert --the--.

Column 5, line 41, after "FIG. 3" insert --,--.

Column 6, line 46, delete "pair" and substitute therefor --pairs--.

IN THE CLAIMS

Column 7, line 19, delete "I claim:" and substitute therefor --We claim:"--.

Col. 7, claim 1, line 59, delete "outer" and substitute therefor --outlet--.

Col. 8, claim 2, line 9, delete "extend" and substitute therefor --extent--.

Col. 8, claim 3, line 53, delete "outer" and substitute therefor --outlet--.

UNITED STATES PATENT AND TRADEMARK OFFICE

CERTIFICATE OF CORRECTION

PATENT NO. : 5,058,395

DATED : October 22, 1991

INVENTOR(S) : Shimao Ni et al.

It is certified that error appears in the above-identified patent and that said Letters Patent is hereby corrected as shown below:

Col. 9, claim 4, line 6, delete "extend" and substitute therefor --extent--.

Signed and Sealed this

Third Day of May, 1994

Bruce Lehman

BRUCE LEHMAN

*Commissioner of Patents and Trademarks*

*Attest:*

*Attesting Officer*